US007310849B2

(12) United States Patent
White et al.

(10) Patent No.: US 7,310,849 B2
(45) Date of Patent: Dec. 25, 2007

(54) VENT BRUSH HAVING FLEXIBLE BRISTLE SUPPORT

(75) Inventors: Carly White, Medford, MA (US); Alberto Mantilla, Rego Park, NY (US); Anthony J. Baxter, New York, NY (US); Yvonne Lin, Brooklyn, NY (US)

(73) Assignee: Conair Corporation, Stamford, CT (US)

( * ) Notice: Subject to any disclaimer, the term of this patent is extended or adjusted under 35 U.S.C. 154(b) by 772 days.

(21) Appl. No.: 10/601,708

(22) Filed: Jun. 23, 2003

(65) Prior Publication Data

US 2004/0255967 A1 Dec. 23, 2004

(51) Int. Cl.
*A46D 1/00* (2006.01)

(52) U.S. Cl. ..... 15/207.2; 15/176.4; 15/186

(58) Field of Classification Search ..... None
See application file for complete search history.

(56) References Cited

U.S. PATENT DOCUMENTS

| | | | |
|---|---|---|---|
| D33,575 | S | 11/1900 | Marshall |
| D38,584 | S | 5/1907 | Kolb |
| D39,451 | S | 8/1908 | Herbert |
| D39,474 | S | 9/1908 | Herbert |
| D39,475 | S | 9/1908 | Herbert |
| D39,504 | S | 9/1908 | Herbert |
| D39,506 | S | 9/1908 | Herbert |
| 918,929 | A | 4/1909 | Thurman |
| D47,578 | S | 7/1915 | Berry |
| D147,710 | S | 10/1947 | Witte |
| D159,981 | S | 9/1950 | Gustafson et al. |
| D180,848 | S | 8/1957 | Scholl |
| 3,053,264 | A | 9/1962 | Breton |
| 3,253,292 | A | 5/1966 | Herschensohn |
| D227,621 | S | 7/1973 | Lindbo |
| D231,506 | S | 4/1974 | Karabelas |
| 3,843,990 | A | 10/1974 | Lardenois |
| 3,970,093 | A | 7/1976 | Lardenois |
| D242,750 | S | 12/1976 | Misercola |
| D244,568 | S | 6/1977 | Lepisto et al. |
| D249,909 | S | 10/1978 | Epstein |
| D253,321 | S | 11/1979 | Saute |
| D253,322 | S | 11/1979 | Saute |
| 4,423,531 | A | 1/1984 | Wall |
| 4,475,563 | A | 10/1984 | Martin |
| 4,500,939 | A | 2/1985 | Gueret |
| 4,566,145 | A | 1/1986 | Wachtel |
| D290,910 | S | 7/1987 | Steadman et al. |
| D291,029 | S | 7/1987 | Purvis et al. |
| 4,797,966 | A | 1/1989 | Fong |
| 4,875,792 | A | 10/1989 | Canada |
| 4,932,425 | A | 6/1990 | Chen |
| D326,190 | S | 5/1992 | Caron |
| 5,327,611 | A | 7/1994 | Balster et al. |

(Continued)

*Primary Examiner*—David Redding
(74) *Attorney, Agent, or Firm*—Lawrence Cruz

(57) ABSTRACT

A hairbrush includes a body and a panel having bristle mounts and support legs. Each of the bristle mounts is secured to at least three of the support legs in a network arrangement that defines openings for passage of an air-stream through the panel. The hairbrush includes bristles located at a first set of bristle mounts. The hairbrush may also support clusters of bristles in recesses defined in hubs located at a second set of bristle mounts. The hairbrush may include a head portion defining a central opening across which the panel extends. Alternatively, the panel may be secured to the body in a substantially cylindrical configuration.

11 Claims, 13 Drawing Sheets

U.S. PATENT DOCUMENTS

| | | | |
|---|---|---|---|
| 5,348,030 | A | 9/1994 | Hirzel |
| D358,489 | S | 5/1995 | Balster et al. |
| D366,567 | S | 1/1996 | Gertsma et al. |
| D370,349 | S | 6/1996 | Yu |
| 5,564,153 | A | 10/1996 | Lange |
| D378,958 | S | 4/1997 | Yu |
| 5,657,775 | A | 8/1997 | Chou |
| D389,651 | S | 1/1998 | Chan et al. |
| 5,749,115 | A | 5/1998 | Franke |
| 5,815,877 | A | 10/1998 | Heneveld |
| 5,868,148 | A | 2/1999 | Lindsey et al. |
| 5,975,089 | A | 11/1999 | Simon |
| 6,006,395 | A | 12/1999 | Tiramani et al. |
| 6,142,157 | A | 11/2000 | De Laforcade |
| D434,910 | S | 12/2000 | Kim |
| D435,172 | S | 12/2000 | Hsieh |
| 6,196,235 | B1 | 3/2001 | Kim |
| D439,747 | S | 4/2001 | Harris et al. |
| D455,560 | S | 4/2002 | Kim |
| D456,610 | S | 5/2002 | Kwong |
| D456,611 | S | 5/2002 | Kwong |
| D457,729 | S | 5/2002 | Humphrey |
| D457,730 | S | 5/2002 | McCurrach |
| D461,961 | S | 8/2002 | Chen |
| D462,483 | S | 9/2002 | Campbell |

VENT BRUSH HAVING FLEXIBLE BRISTLE SUPPORT

FIELD OF THE INVENTION

The present invention relates to hairbrushes. More particularly, the present invention relates to a hairbrush having a bristle support panel that is vented to provide for passage of an airstream through the hairbrush.

BACKGROUND OF THE INVENTION

Hairbrushes known as vent brushes include openings in a bristled head portion to provide for passage of an airstream through the vent brush. Vent brushes are commonly used with hand-held hair dryers for controlled hair drying or styling by directing a heated airstream directed through the bristled head portion.

It is known, as disclosed in U.S. Pat. No. 4,500,939 to Gueret, to provide a vent brush having a separate bristle support received within an aperture defined by a brush head portion. Gueret shows a bristle support (1; FIG. 1) that includes concentric oval shaped elements (3, 5; FIG. 1) intersected by ribs (6, 7, 8, 9, 10). Bristles (11) are secured to the ribs equidistantly between the intersections with the oval elements. Gueret also shows a bristle support (18; FIG. 8) including ribs (19) intersecting each other at right angles. Bristles (20) are secured to the ribs between the intersections.

SUMMARY OF THE INVENTION

According to the present invention, a hairbrush is disclosed that includes a body and a panel. The panel includes bristle mounts and support legs arranged in a network that defines openings for passage of an airstream through the panel. At least a portion of the network includes bristle mounts and support legs arranged in a pattern in which each bristle mount is secured to at least three of the support legs. The hairbrush further includes bristles each secured to one of the bristle mounts of the patterned portion of the network.

According to one embodiment of the invention, the bristle mounts are arranged in first and second sets of mounts. Each of the legs of the network is secured at one end to one of the bristle mounts of the first set and at an opposite end to one of the mounts of the second set. The bristles may include a first set of relatively thick bristles secured to the bristle mounts of the first set and clusters of relatively thin bristles secured to the bristle mounts of the second set.

According to one embodiment of the invention, the body includes a head portion defining a central opening and the panel extends across the central opening. Alternatively, the panel is secured to the body in a substantially cylindrical configuration. Preferably, a relatively rigid reinforcement member is located adjacent the substantially cylindrical panel.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For purposes of illustrating the invention, the drawings show one or more preferred forms in which the invention can be embodied. The invention is not, however, limited to the precise forms shown unless such limitation is expressly made in a claim. In the drawings:

DETAILED DESCRIPTION OF THE DRAWINGS

Figure 1:
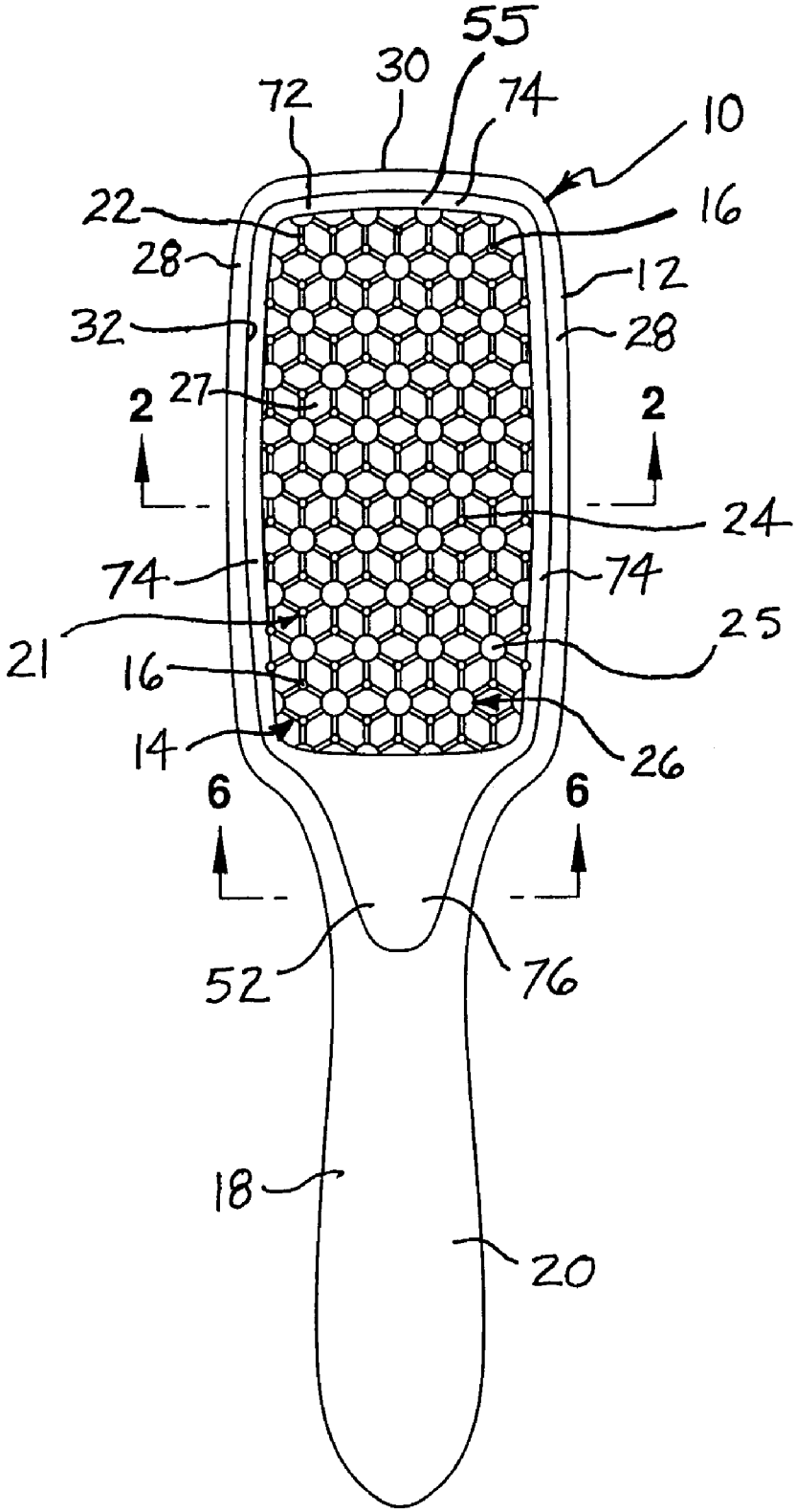
FIG. 1 is a front elevation view of a vent brush according to one embodiment of the present invention.

Referring to the drawings, where like numerals identify like elements, there is illustrated in FIG. 1 a hairbrush 10 according to the present invention. The hairbrush 10 includes a head portion 12 and a panel 14 secured to the head portion. As used herein, the term "secured" includes attached, adhered and formed integrally with. The hairbrush 10 also includes bristles 16 secured to the panel 14. The hairbrush 10 is vented to provide for passage of an airstream through the panel 14 and the bristles 16, from a handheld hair dryer for example. The head portion 12 and panel 14 flexibly support the bristles 16 to provide a cushioning effect for the bristles during contact with a user's scalp. The construction of the hairbrush 10 also provides access to the bristles 16 that facilitates cleaning of the panel 14 and the bristles 16.

The head portion 12 of the hairbrush 10 forms a portion of a hairbrush body 18 that also includes a handle 20 attached to the head 12. Preferably, the handle 20 and the head portion 12 of the body 18 are formed integrally, such as from a molded plastic material. As shown in the section views of FIGS. 2-3, the bristles 16 of the hairbrush 10 are secured to the panel 14 such that the bristles 16 extend forwardly with respect to the hairbrush 10 from the panel 14.

The panel 14 includes bristle supports 21 each having a bristle mount 24 and three support legs 22 extending outwardly from the bristle mount 24. The bristles 16 are secured to the bristle mounts 24 of the bristle supports 21 such that each bristle 16 extends substantially perpendicular to the plane of the panel 14. The term "plane of the panel" refers to a localized space occupied by a portion or element of the panel 14 and is used herein to describe relative orientation for an element. The term should not be understood as requiring that the panel 14, or any portion of the panel, be planar. Because of the perpendicular orientation of the bristles 16 with respect to the plane of panel 14, the bristles 16 will extend in a generally forward direction with respect to brush 10. Preferably, the mounts and support legs of the bristle supports 21 are formed integrally with the bristles 16.

The panel 14 also preferably includes disc-shaped hubs 25. As shown in FIG. 1, the bristle supports 21 and hubs 25 are arranged in a repeating pattern in which each of the legs 22 is secured at an end to one of the hubs 25 opposite the bristle mount 24. The bristle supports 21 and the hubs 25 form a network defining openings 27. The hubs 25, as will be described in greater detail, may be adapted to form a second set of bristle mounts 26 for supporting additional bristles.

Figure 2:
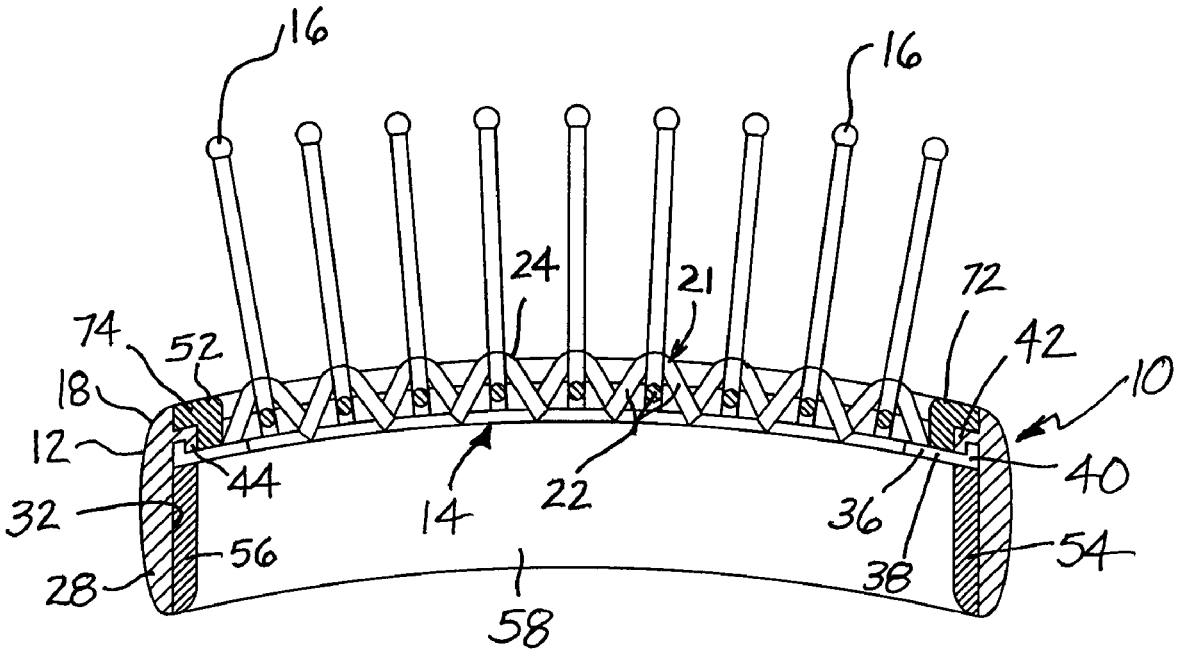
FIG. 2 is a section view of the vent brush of FIG. 1 taken along the lines 2-2.
Figure 4:
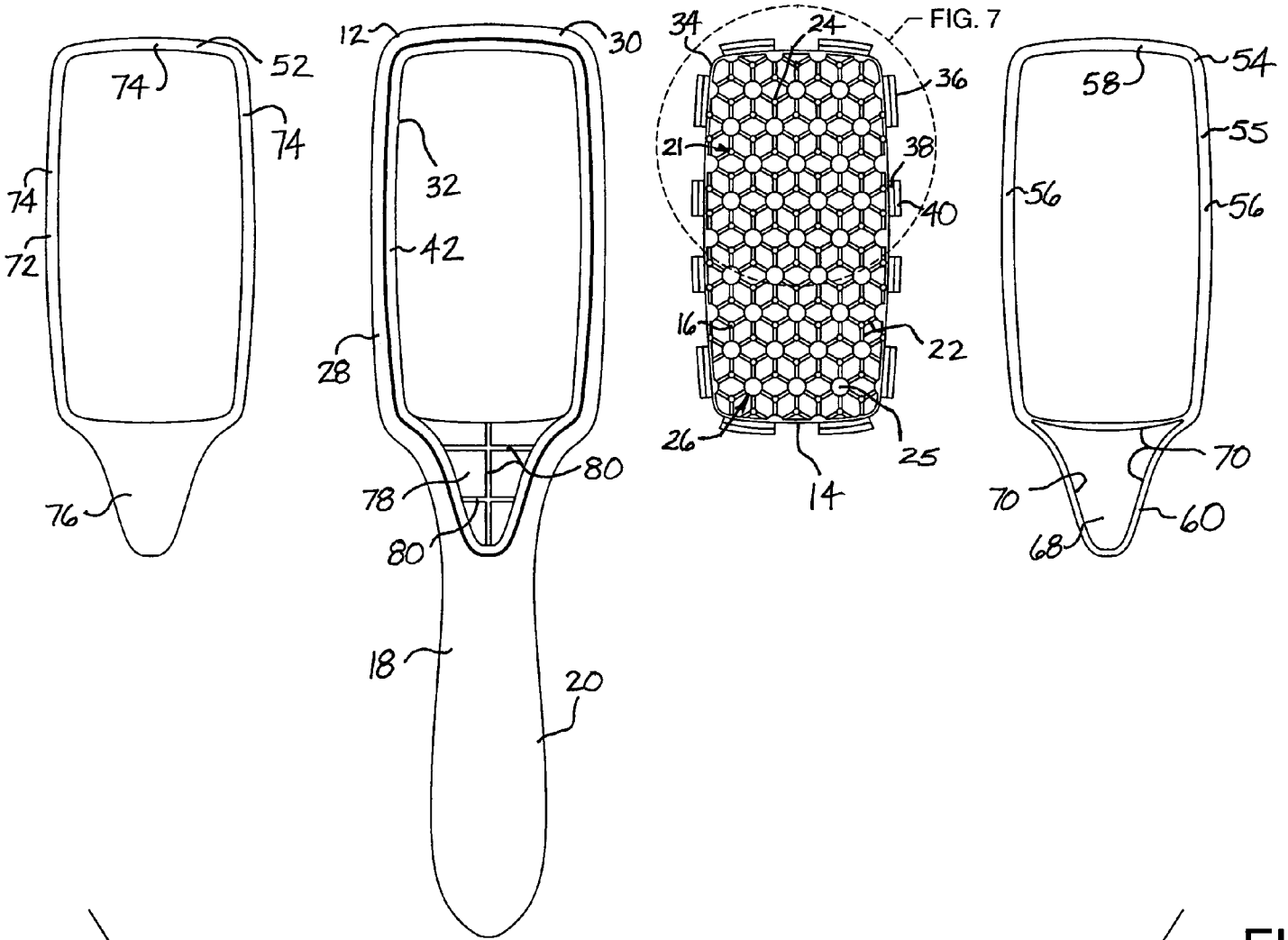
FIG. 4 is a front elevation views of the front insert, body, panel and rear insert, respectively, of the vent brush of FIG. 1.
Figure 5:
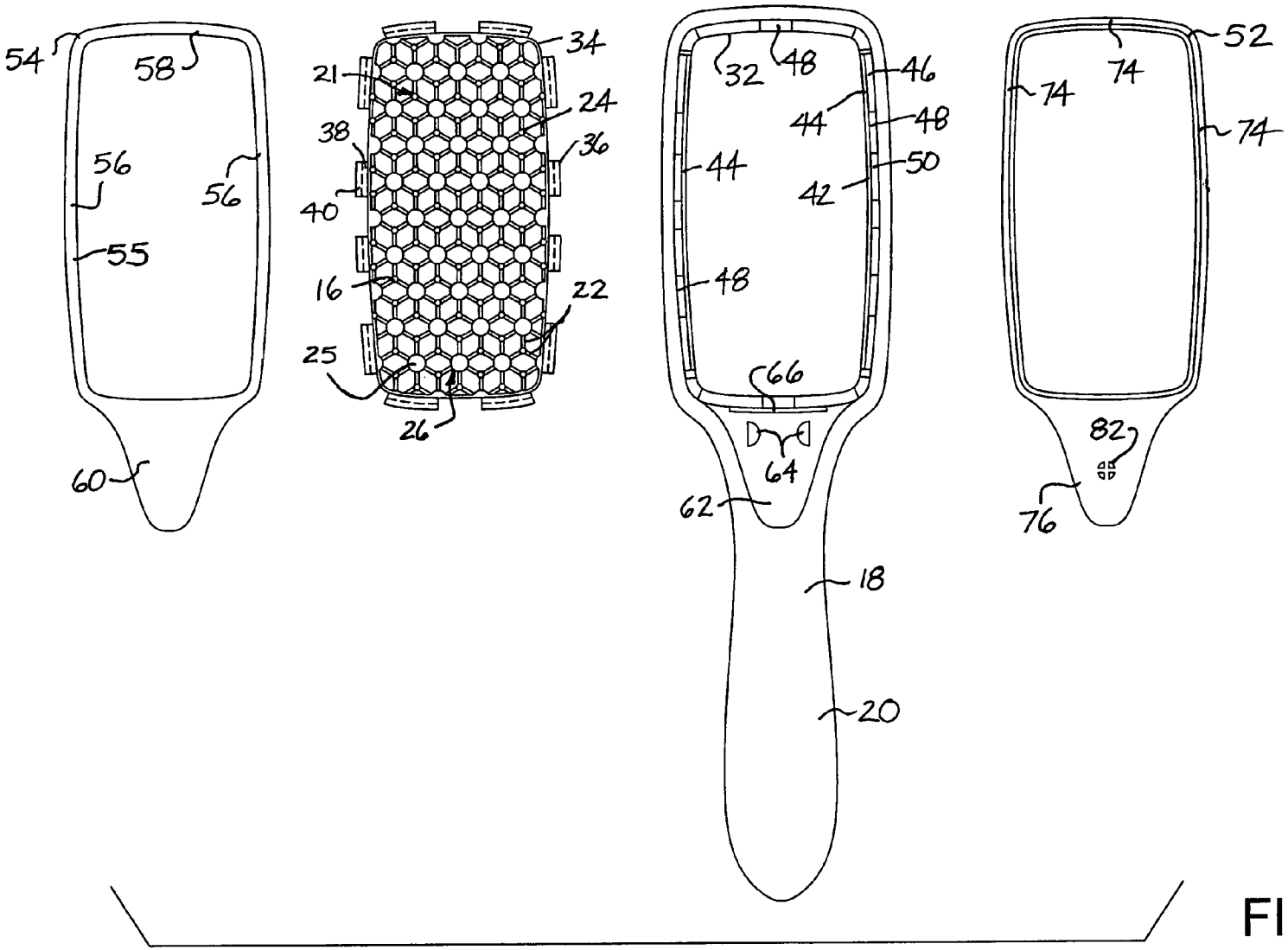
FIG. 5 is a rear elevation views of the rear insert, panel, body and front insert, respectively, of the vent brush of FIG. 1.

The panel 14 of the hairbrush 10 is mounted so as to provide an array of vents or passages 27 for air to pass through, such as from a hand-held hair dryer. As shown in FIGS. 4-5, the head portion 12 of body 18 includes opposite sidewalls 28 and an end wall 30 opposite the handle 20. The walls 28, 30 of the head 12 and the handle 20 define a central opening 32 that occupies a majority of the head 12. The flexible panel 14 is received within the central opening 32 and secured therein such that an airstream directed into the central opening 32 will pass through the openings 27 defined by the panel 14 and the bristles 16 supported by the panel 14. As shown in FIG. 2, the head portion 12 of body 18 is preferably sized and shaped to introduce curvature into the panel 14 across the head portion 12 when the panel is secured within the central opening 32.

Figure 3:
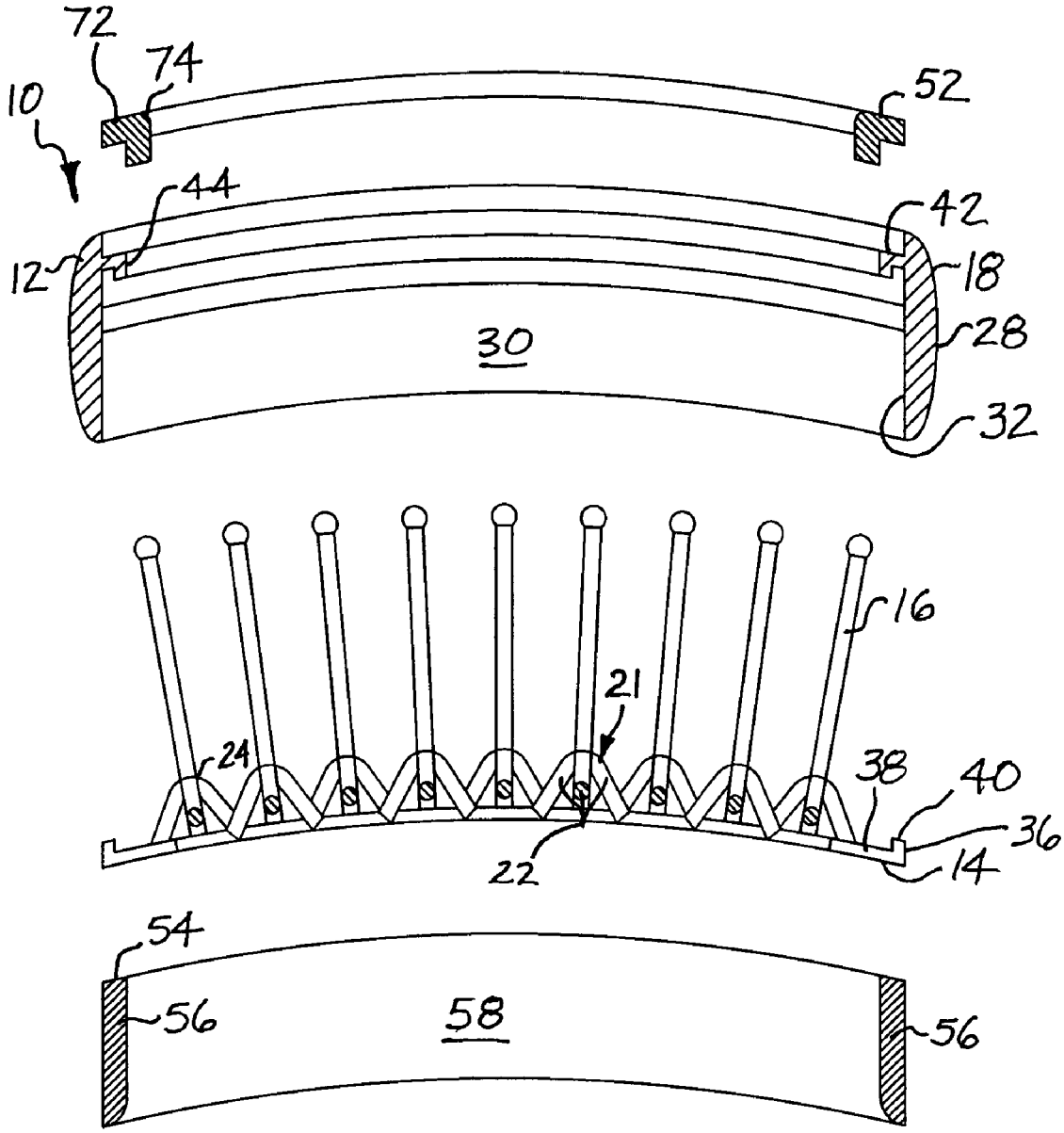
FIG. 3 is an exploded section view of the vent brush of FIG. 2.

The panel 14, in one embodiment, includes a substantially rectangular outer rim 34 secured to the network array of bristle supports 21 and hubs 25 such that the outer rim 34 surrounds the network. The panel 14 further includes tabs 36 secured to the outer rim 34 opposite the network. The tabs 36 are spaced about the outer rim 34 for holding the panel 14 within the central opening 32 of the head 12. As seen in FIG. 3, each of the tabs 36 is generally L-shaped in cross-section having a first portion 38 that extends outwardly from the outer rim 34. Each tab 36 includes a second portion 40 extending forwardly with respect to the rim 34 in a substantially upstanding orientation with respect to the first portion 38.

The head portion 12 of the body 18 includes a retainer lip 42 extending into the central opening 32 from the walls 28, 30 and from the handle 20. As shown in FIG. 3, the retainer lip 42 includes portions 44 extending rearwardly at an inner periphery of the lip to define recesses 46. The holding tabs 36 of the panel 14 engage the retainer lip 42 when the panel 14 is placed in the central opening 32 such that the forwardly-extending portions 40 of the tabs 36 are received in the recesses 46. While the figures illustrate one preferred mechanism for attaching the panel to the handle, other mounting arrangements are well within the scope of the invention.

Referring to the rear elevation views of FIG. 5, the body 18 illustrated includes insert supports 48 extending rearwardly from the retainer lip 42 adjacent the walls 28, 30 of the head 12 and the handle 20. The insert supports 48 are spaced about the central opening 32 to define gaps 50 therebetween. The gaps 50 are sized to accommodate the holding tabs 36 of the panel 14 to provide for the above-described engagement between the panel 14 and the retainer lip 42. The insert supports 48 preferably extend from the recesses 46 such that the insert supports are substantially flush with, or extend slightly beyond, the holding tabs 36 of the panel 14 when the panel 14 is engaged to the retainer lip 42.

The hairbrush 10 further includes front and rear inserts 52, 54 received in the central opening 32 of the body 18 on opposite sides of the retainer lip 42 and the panel 14. The rear insert 54 includes a head portion 55 having walls 56 on opposite sides and a wall 58 at an end of the rear insert. The rear insert 54 is received by the body 18 such that the walls 56, 58 of the rear insert are located adjacent the respective walls 28, 30 of the body 18. The head portion 55 of the rear insert 54 contacts the insert supports 48 of the body 18 such that the rear insert 54 covers the holding tabs 36 of the panel 14 securing the panel 14 within the central opening 32.

The rear insert 54 may also include a tail portion 60 that is received within a recess 62 formed in the handle 20 of the body 18. As shown in the rear views of FIG. 5, the body 18 includes a pair of posts 64 and an elongated member 66 located within the handle recess 62. As shown in FIG. 4, a recess 68 is also formed in the tail portion 60 of the rear insert 54. The tail portion recess 68 defines inner side surfaces 70 that slidably engage the posts 64 and the elongated member 66 of the body 18 for securing the rear insert 54 within the central opening 32. The rear insert 54 is also preferably further secured to the body 18 by an adhesive included between the insert supports 48 and the rear insert 54.

The hairbrush 10 of the first embodiment also includes a front insert 52 that is received within the central opening 32 from the front side of the body 18. The front insert 52 includes a head portion 72 having substantially L-shaped walls 74 and a tail portion 76. As shown in FIG. 2, the head portion 72 of the front insert 52 engages the retainer lip 42 of the body 18 opposite the rear insert 54. Referring to the front views of FIG. 4, the handle 20 defines a recess 78 that receives the front insert tail portion 76.

Figure 6:
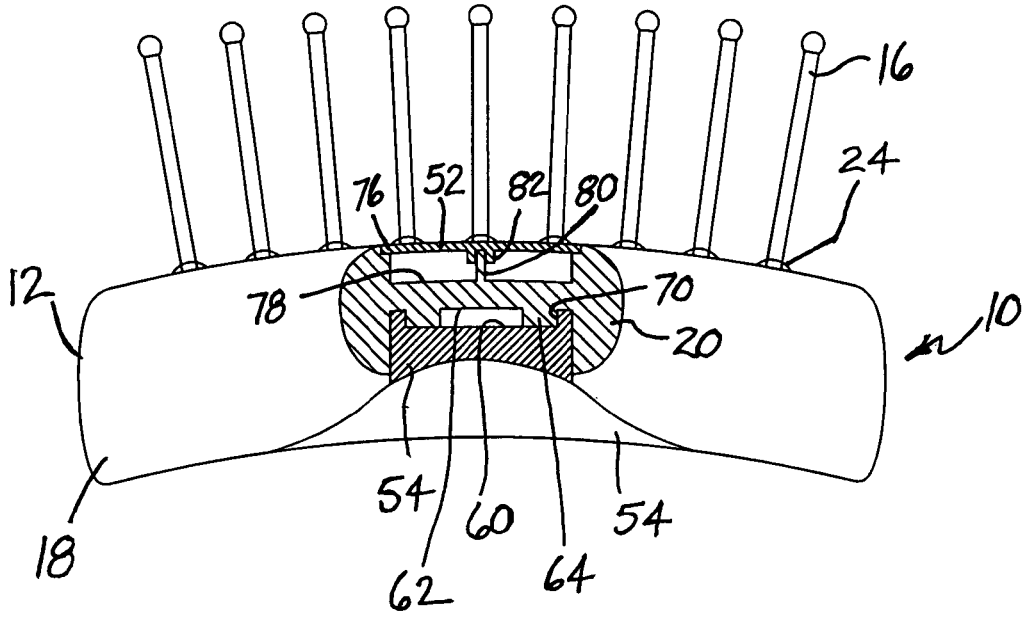
FIG. 6 is a section view of the vent brush of FIG. 1 taken along the lines 6-6.

The body 18 of brush 10 preferably includes elongated projections 80 located in the front handle recess 78 that are oriented to intersect with each other. Referring to FIG. 5, the tail portion 76 of the front insert 52 includes projections 82 on its rear side which are arranged in a cluster. As shown in FIG. 6, the cluster of projections 82 is positioned on the front insert 52 to engage between the clustered projections 82 and one of the intersections of the elongated projections 80 on the handle recess 78. The front insert 52 is also preferably secured to the body by an adhesive located between the clustered projections 82 and the elongated projections 80 and between the head 12 and the retainer lip 42. The mounting arrangement described above is one preferred method for mounting the front insert. Those skilled in the art would readily appreciate that other mounting arrangements can be used in the present invention.

The engagement between the inserts 52, 54 and the retainer lip 42 secures the panel 14 within the central opening 32 of the body 18. As described above, the rear insert 54 prevents rearward removal of the panel 14 from the brush 10. The front insert 52, however, also facilitates a secured connection between the panel 14 and the body 18 by contacting the support 14 as shown in FIG. 2. An inner edge of the front insert 52 also preferably contacts the outermost ones of the bristles 16 further securing the attachment of the panel 14 by limiting relative rotation of the support 14 along its outer periphery.

Figure 8A:
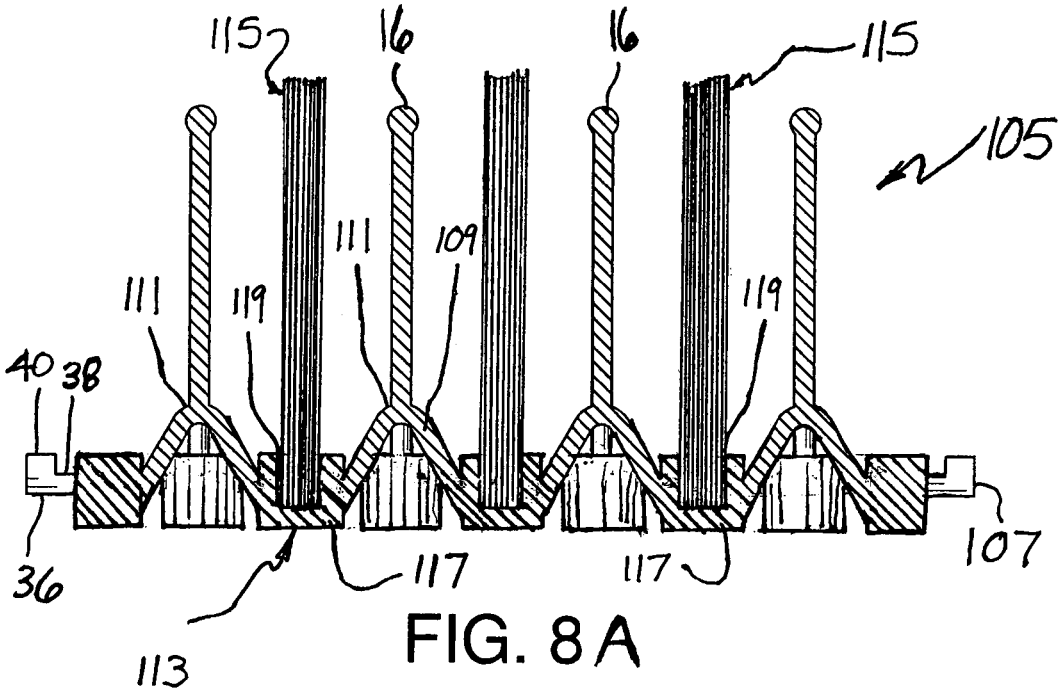
FIG. 8A is a partial sectional view of a further alternative panel.
Figure 7:
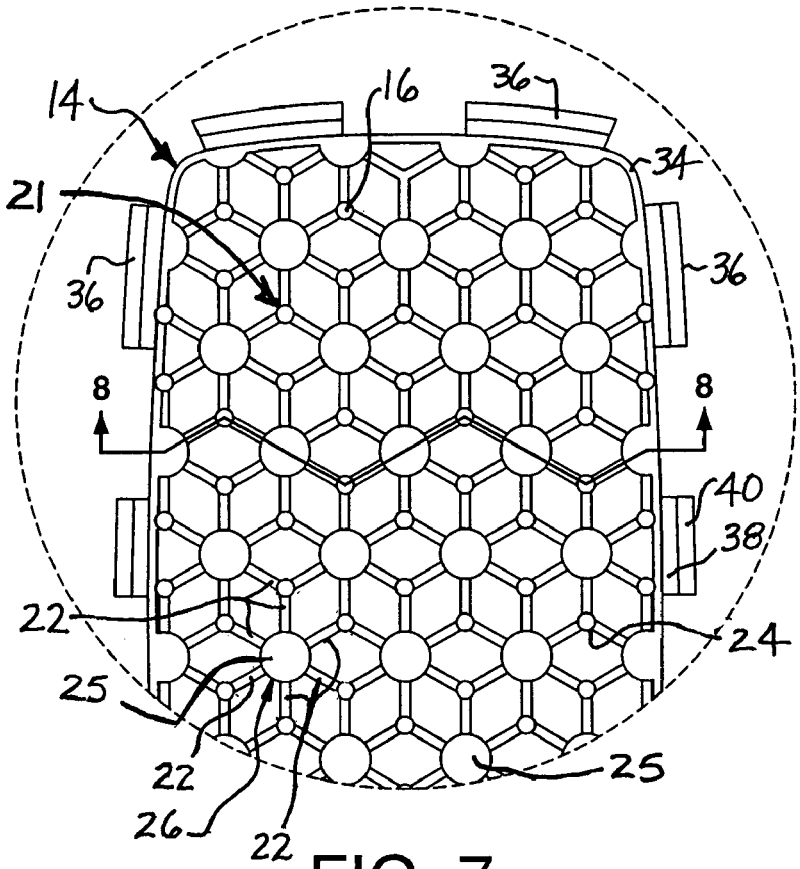
FIG. 7 is an enlarged detail view of a portion of the panel of FIG. 4.
Figure 8:
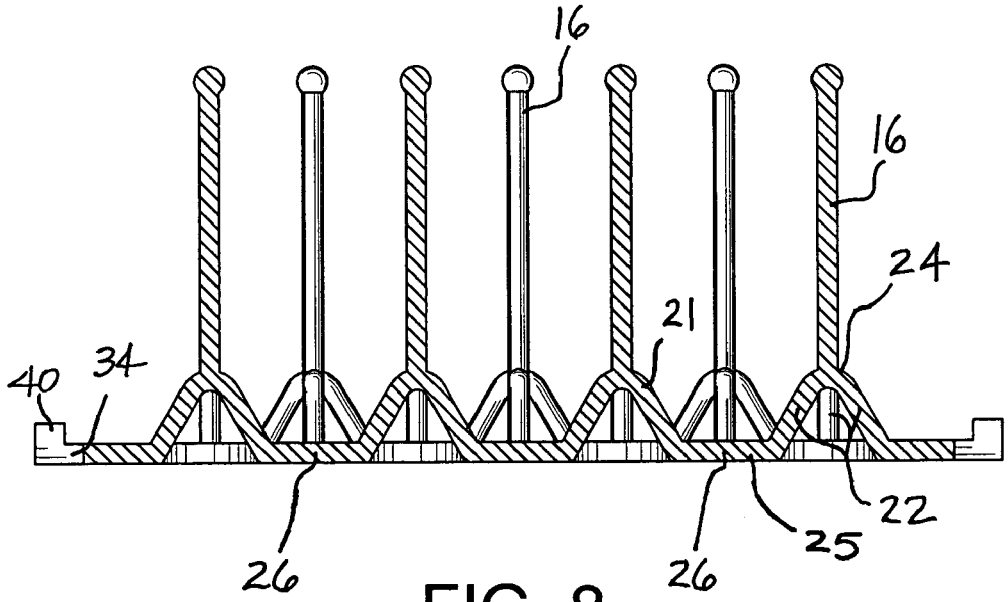
FIG. 8 is a section view of the panel of FIG. 7 taken along the lines 8-8.

Referring to FIGS. 7 and 8, the construction of the panel 14 is shown in greater detail. As described above, each of the bristle supports 21 includes a central bristle mount 24 and three support legs 22 extending outwardly from the bristle mount 24. The hubs 25 form a second set of bristle mounts 26 in the network array in addition to the first set of bristle mounts 24. As shown, there are preferably twice as many of the first set of bristle mounts 24 as the second set of bristle mounts 26. The bristle mounts 24, 26 are arranged in the network array of panel 14 such that each of the legs 22 is secured at one end to one of the first bristle mounts 24 and at an opposite end to one of the second bristle mounts 26. As a result of this construction, each of the second set bristle mounts 26 is connected to six of the legs 22. The ends of the six legs 22 associated with each of the second set bristle mounts 26 are secured about an outer periphery of the respective hub 25.

As described above, each of the bristles 16 of hairbrush 10 is secured to one of the bristle mounts 24 of the first set of mounts and is preferably formed integrally with the panel 14. In addition to providing for passage of an airstream through the openings 27, the repeating pattern defined by the legs 22 and the bristle mounts 24, 26 facilitates a uniformly flexible support response during contact between the bristles 16 and a person's scalp for example.

Referring to FIG. 8, the first bristle mounts 24 are offset forwardly from the second bristle mounts 26. As a result, each of the legs 22 extends between one of the first mounts 24 and one of the second mounts 26 at an oblique angle with respect to the plane of the panel at the second mount 26. Arranged in this manner, each of the bristle supports 21 forms a tripod support structure for the associated bristle 16.

As discussed above, the head portion 12 of hairbrush 10, and the panel 14 secured thereto, are rectangular in shape in the first embodiment. However, the invention is not limited to this configuration. The head portion 12 and panel 14 could, alternatively, have sides defining other shapes such as a hexagon, or could be rounded in the form of an oval, for example.

As described above, the hairbrush 10 includes front and rear inserts 52, 54 received in the central opening 32 on opposite sides of the retainer lip 42. It is contemplated, however, that the panel could be secured within the central opening of the head by a single insert received from either the front or rear of the brush. In such case, the lip extending into the central opening could be formed flush with the front or rear of the brush opposite the insert.

The legs 22 of the network array could have a construction that varies from that included in panel 14. Referring to FIG. 7A for example, there is shown a portion of a panel 79 according to the present invention including legs 81 and first and second bristle mounts 83, 85, respectively. Each of the second bristle mounts 85 includes a hub 87 having an outer periphery to which the second ends of the legs 81 are secured. The elongated members 81 and nodes 83, 85 form a network array that defines openings 89. The hubs 87 are substantially reduced in size in comparison with the hubs 25 of the panel 14. Otherwise, however, the panel 79 is similar in construction to panel 14 and includes the substantially two to one ratio between the first and second bristle mounts 83, 85, respectively, and the resulting "three and six" arrangement between the opposite ends of the legs.

As shown in FIGS. 7 and 8, each of the legs 22 of panel 14 is substantially uniform in cross section along its length.

Figure 7B:
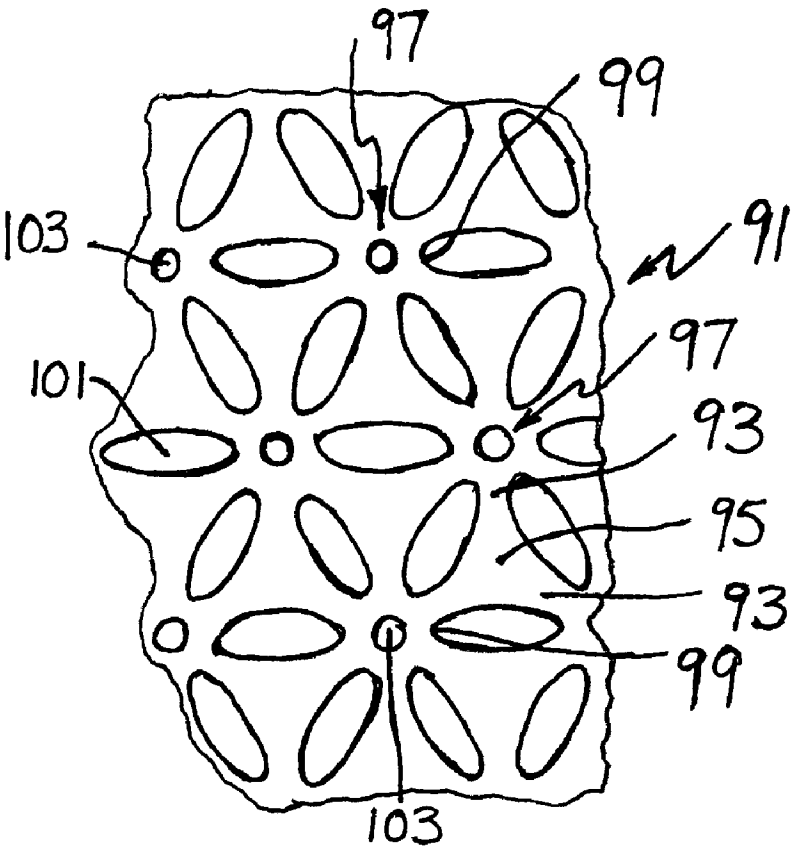
FIG. 7B is a partial front view showing a further alternatively constructed panel according to the present invention.
Figure 7A:
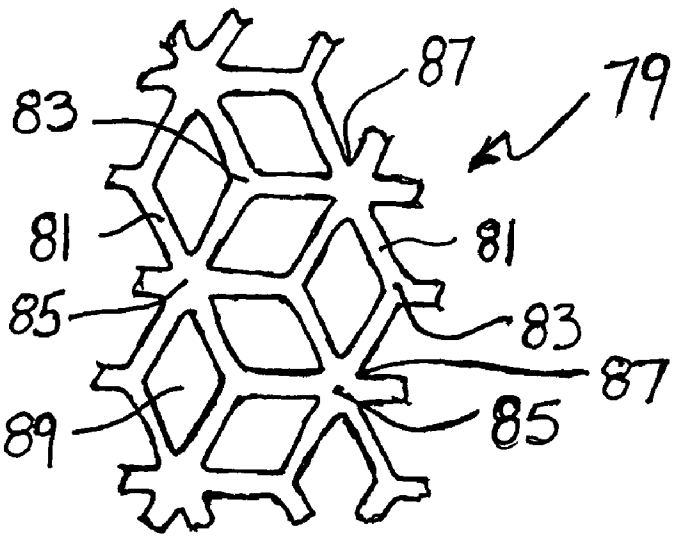
FIG. 7A is a partial front view of an alternatively constructed panel.

Referring to FIG. 7B, there is shown an alternative panel 91 including legs 93 each extending between first and second bristle mounts 95, 97. In this embodiment, there are preferably twice as many of the first bristle mounts 95 as the second bristle mounts 97, thus providing a "three and six" arrangement of legs 93 in a similar fashion to panels 14, 79. The second bristle mounts also include hubs 99. As shown, each of the legs 93 has a cross sectional width that varies along the length of the leg from a minimum width adjacent the hub 99 of the second bristle mount 97 to a maximum width adjacent the associated first bristle mount 95. The legs 93 and the bristle mounts 95, 97 form a network array defining openings 101. The panel 91 also includes openings 103 each located in the centers of the hubs 99 creating a pattern for the network array in which the openings 101 resemble petals of a flower.

The hairbrush 10 of FIGS. 1-7 includes bristles 16 at the first bristle mounts 24. Referring to FIG. 8A, there is shown a hairbrush 105 according to the present invention having additional bristles. The hairbrush 105 includes a panel 107 that, in a similar fashion to panel 14, includes legs 109 and first and second bristle mounts 111, 113. The hairbrush 105 includes bristles 16 located at the first bristle mounts 111 which are preferably formed integral with the panel 107. The hairbrush 105 further includes clusters 115 of relatively thin bristles, such as boars-hair bristles. Each of the clusters 115 is received in a recess opening 119 in a hub 117 at one of the second bristle mounts 113. As shown, the hub 117 has a depth that is increased in comparison with the hubs 25 of panel 14. The clusters 115 of boars-hair bristles are preferably secured to the hubs 117 using a suitable adhesive.

As shown in FIG. 8A, the location of the bristles 16 and the clusters 115 of boars-hair bristles at the bristle mounts 111, 113, respectively, results in dispersing of the clusters 115 of boars-hair bristles among the relatively thick bristles 16. The construction of the network array in which the bristle mounts 111 outnumber the bristle mounts 113 by approximately two-to-one results in a bristle arrangement in which each of the clusters 115 of boars-hair bristles is substantially surrounded by adjacently located bristles 16. As shown, each of the clusters 115 of boars-hair bristles extends forwardly from the panel 107 beyond the adjacently located bristles 16. This construction ensures that the relatively rigid bristles 16 will not prevent contact between a user of the hairbrush 105 and the clusters 115 of boars-hair bristles.

Figure 9:
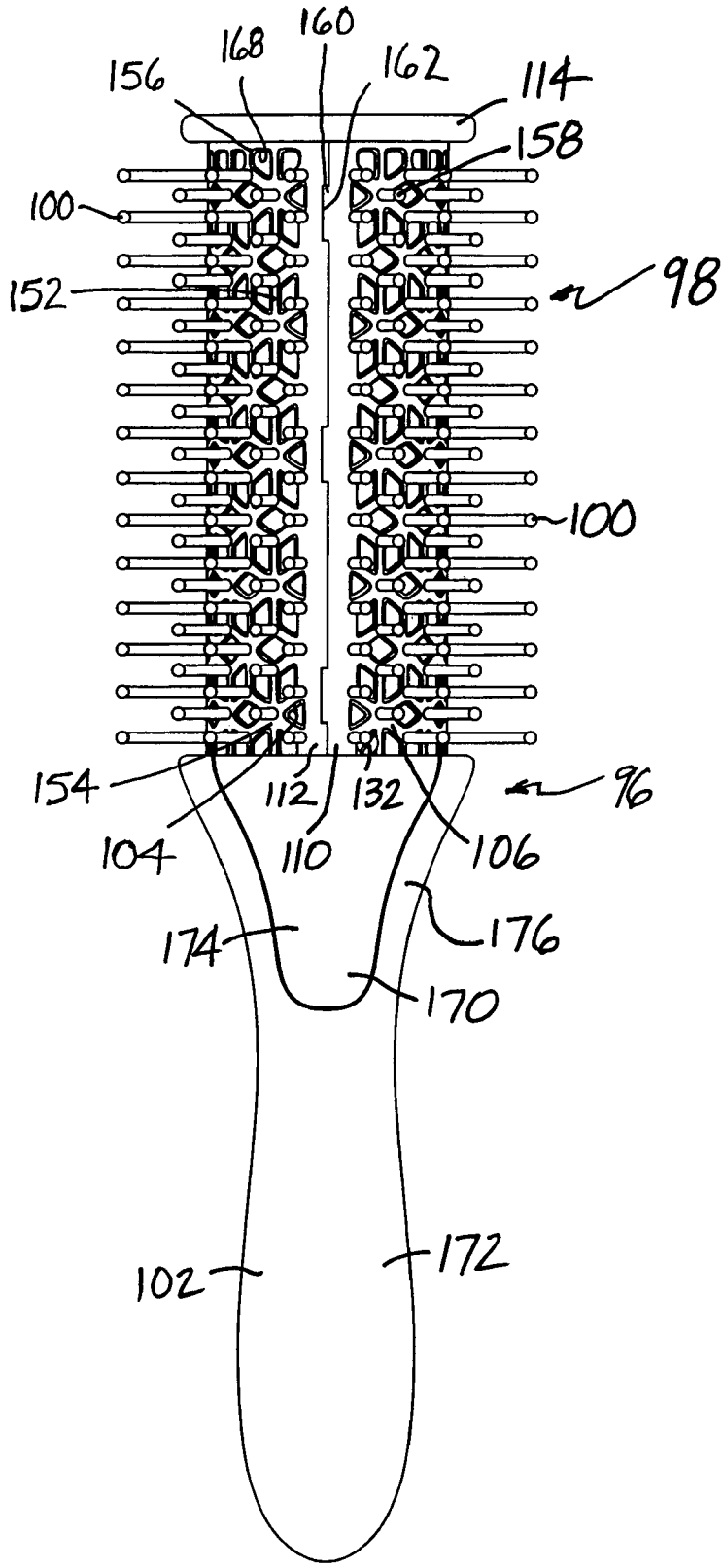
FIG. 9 is an elevation view of a vent brush according to a further embodiment of the present invention.
Figure 10:
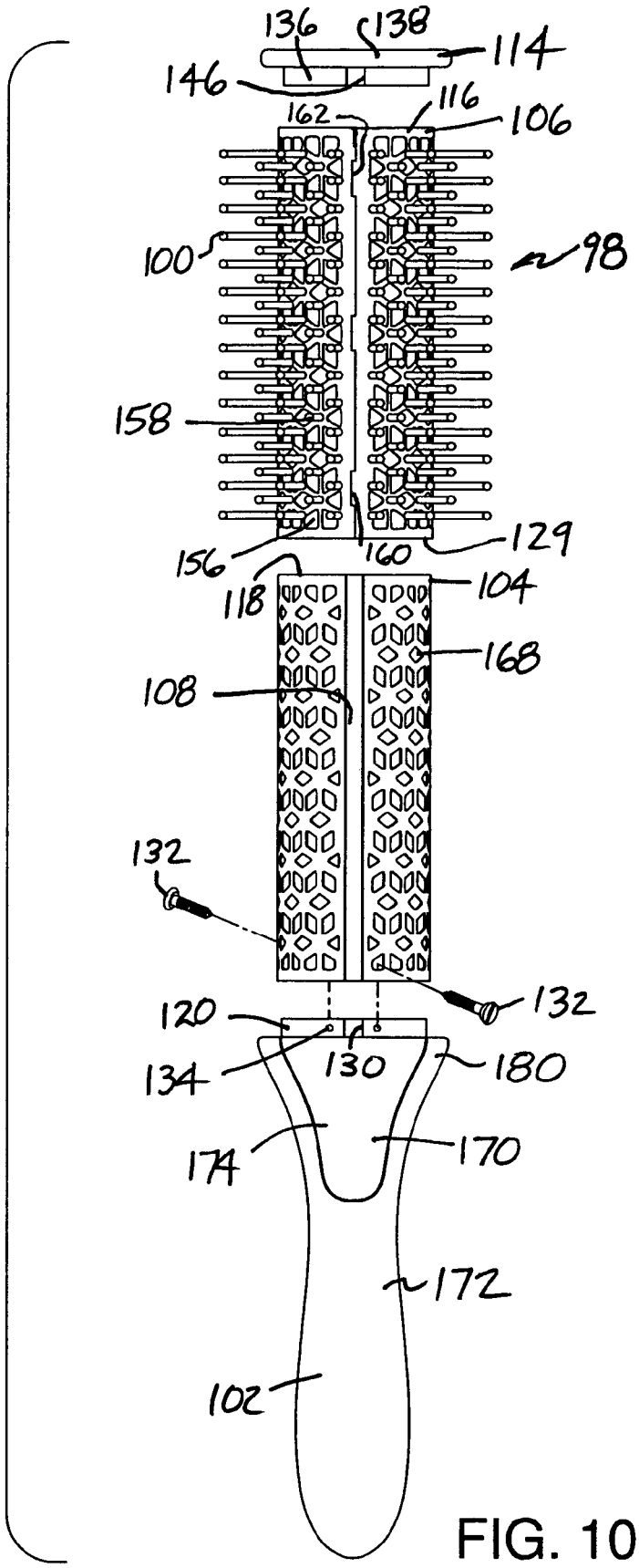
FIG. 10 is an exploded view of the vent brush of FIG. 9.

Referring to FIG. 9, there is shown a round hairbrush 96 according to the present invention having a vented head 98 bearing bristles 100 secured to a handle 102. As shown in FIG. 10, the head 98 of the hairbrush 96 preferably includes a relatively rigid reinforcement member 104 and a relatively flexible panel 106 carrying the bristles 100. The reinforcement member 104, preferably made from a metal or plastic, is generally cylindrical in shape. The reinforcement member 104 is not a true cylinder, however, and includes a discontinuity 108 extending longitudinally along its entire length. As will be discussed in greater detail, the panel 106 includes opposite edge portions 110, 112 adapted for engagement to each other to form the panel 106 into a tubular configuration. The panel 106 is received over the reinforcement member 104 such that the engaged edge portions 110, 112 extend within the discontinuity 108. The round hairbrush 96 also includes a cap 114 that is received by upper ends 116, 118 of the flexible panel 106 and the reinforcement member 104, respectively.

Figure 11:
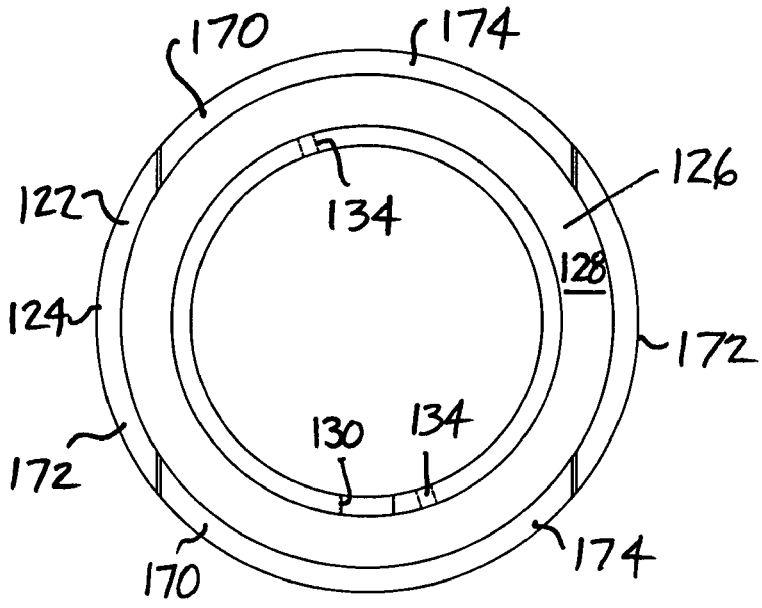
FIG. 11 is a top plan view of the handle of FIG. 10.

Referring to FIG. 11, the handle 102 includes inner and outer rims 120, 122 at an upper end 124 of the handle 102.

The inner and outer rims 120, 122 define an annular recess 126 therebetween and a shoulder 128 extending radially between the inner and outer rims 120, 122. Lower ends 129, 131 of the panel 106 and the reinforcement member 104 are received in the annular recess 126 of handle 102 such that they contact the shoulder 128. The inner rim 120 includes a slot 130 for accommodating the joined edge portions 110, 112 of the panel 106. As shown in FIG. 10, the inner rim 120 extends beyond the outer rim 122 to provide for receipt of screws 132 in holes 134 for securing the reinforcement member 104 to the handle 102.

Figure 12:
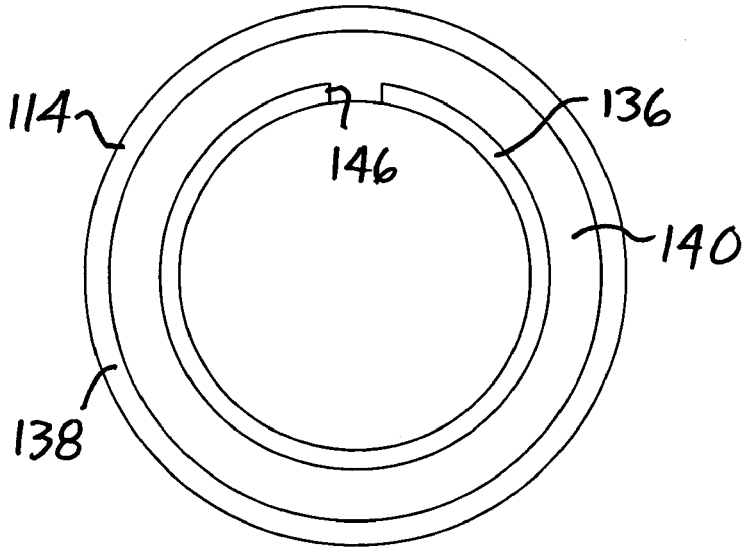
FIG. 12 is a bottom plan view of the end cap of FIG. 10.

Referring to FIG. 12, the cap 114 includes inner and outer cylindrical rims 136, 138 and an annular plate 140 extending radially between the inner and the outer rims 136, 138. The upper ends 116, 118, of the panel 106 and the reinforcement member 104, respectively, are received between the inner and outer rims 136, 138 of the cap 114 such that the ends 136, 138 contact the annular plate 140. In a similar fashion to the inner rim 120 of the handle 102, the inner rim 136 of cap 114 includes a slot 146 for accommodating the joined edge portions 110, 112 of the panel 106. The cap 114 is preferably secured to the reinforcement member 104 and the panel 106 by an adhesive.

Figure 13:
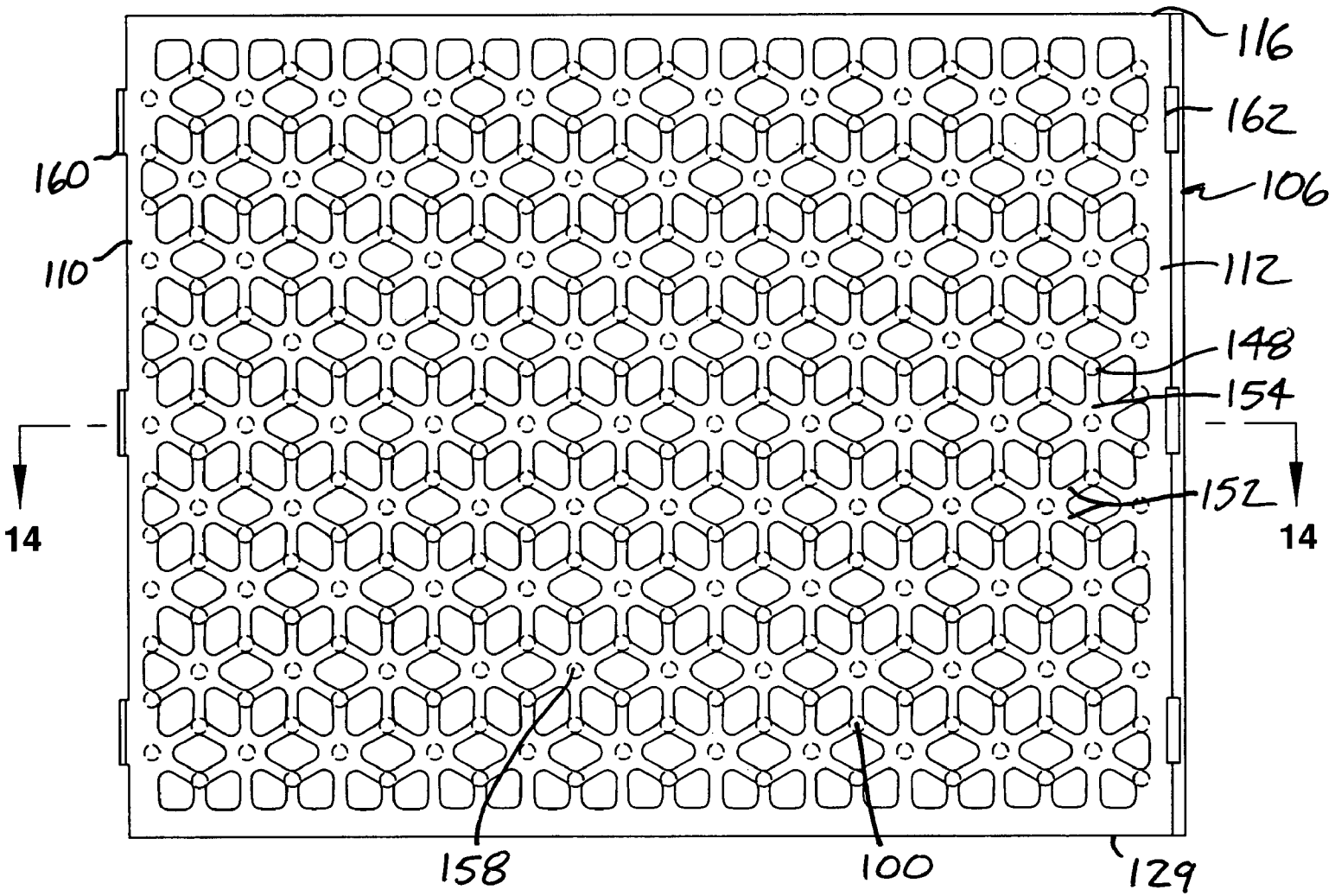
FIG. 13 is a plan view of the bristled member of FIG. 10 shown in an unrolled condition.
Figure 14:
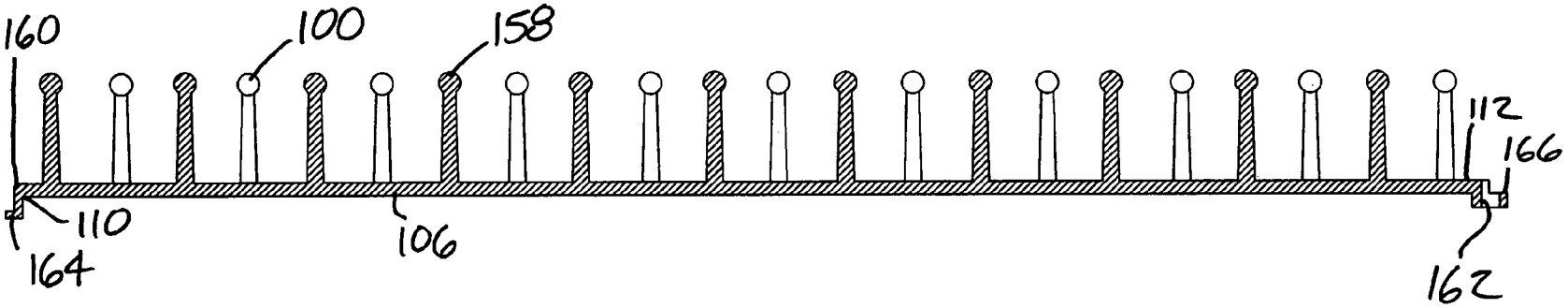
FIG. 14 is a section view taken along the lines 14-14 of FIG. 13.

Referring to FIGS. 13 and 14, the panel 106 is shown in an unrolled, substantially planar, condition. The panel 106 includes bristle mounts 148, 150 of first and second sets of mounts and legs 152. In a similar fashion to panel 14, the panel 106 includes hubs 154 at the second mounts 150 which are arranged with the first mounts 148 in an array which defines openings 156. The panel 106 also includes bristles 158 attached to the hubs 154. Referring to FIG. 14, the legs 152 of the panel 106 are preferably not obliquely angled with respect to the associated hubs 154 as in the previous embodiment.

The edge portions 110, 112 of the panel 106 include tabs and slots 160, 162, respectively, for securing the panel 106 in the cylindrical configuration shown in FIG. 9. As shown in FIG. 14, the tabs 160 of edge portion 110 are substantially L-shaped each including an outwardly extending flange 164 that engages a recessed portion 166 of edge portion 112 to lock the edge portions 110, 112 together.

Referring back to FIGS. 9 and 10, the reinforcement member 104 is perforated with openings 168. The openings 168 of the reinforcement member 104 are arranged to provide for substantial alignment with the openings 156 of the panel 106 as shown. The alignment between the openings 168, 156 of the reinforcement member 104 and the panel 106 provides the venting construction for passage of an airstream through the bristled head 98 of the hairbrush 96.

In this embodiment, the handle 102 includes a substantially rigid plastic core 170 and a layer 172 of rubber applied over the plastic core 170. A portion 174 of an outwardly flared end section 176 of the core 170 is exposed. The handle 102 could, alternatively, be formed of a single, homogenous, material such as the plastic of the core 170.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A hairbrush comprising:

a body;

a panel secured to the body, the panel including bristle mounts and support legs arranged in a network defining openings for passage of an airstream through the panel, at least a portion of the network including bristle mounts and support legs arranged in a pattern in which each bristle mount has at least three support legs extending from it; and a plurality of bristles, each bristle secured to one of the bristle mounts of the patterned portion of the network, wherein the patterned portion of the network includes first and second sets of bristle mounts and wherein the bristles include relatively thick bristles and relatively thin bristles, each of the relatively thick bristles secured to one of the bristle mounts of the first set, and clusters of the relatively thin bristles secured to the bristle mounts of the second set.

2. The hairbrush according to claim 1, wherein each of the clusters of relatively thin bristles is received in a recess defined by the associated bristle mount.

3. The hairbrush according to claim 1, wherein the patterned portion of the network includes first and second sets of bristle mounts and wherein each of the second set bristle mounts is secured to twice as many legs as each of the first set bristle mounts.

4. The hairbrush according to claim 3, wherein each of the first bristle mounts is secured to three legs and each of the second bristle mounts is secured to six legs.

5. The hairbrush according to claim 4, wherein each of the legs within the patterned portion of the network includes opposite ends respectively secured to a bristle mount of the first and second set, and wherein each of the first bristle mounts within the patterned portion of the network is offset forwardly with respect to the associated second bristle mounts such that the first bristle mount and its associated legs form a tripod support structure.

6. The hairbrush according to claim 1, further including an insert having opposite sidewalls received in the central opening adjacent the sidewalls of the body head portion such that removal of the panel is prevented.

7. The hairbrush according to claim 6, wherein the body head portion further includes insert supports on each retainer lip for contact with the insert, and wherein gaps are defined between the insert supports for receipt of the panel holding tabs.

8. The hairbrush according to claim 1, wherein the panel is secured to the body in a substantially cylindrical configuration.

9. A hairbrush comprising:

a body;

a panel secured to the body, the panel including a plurality of openings to provide for passage of an airstream through the panel;

a plurality of first bristles each secured to the panel such that it is spaced apart from the other first bristles; and a plurality of second bristles, the second bristles being grouped in clusters of bristles, each of the clusters being secured to the panel among the first bristles.

10. The hairbrush according to claim 9, wherein the panel includes bristle mounts and support legs arranged in a network defining the openings, at least a portion of the network including first and second sets of bristle mounts arranged in a pattern with the support legs such that each of the legs is respectively secured at opposite ends to a bristle mount of the first set and a bristle mount of the second set, and wherein each of the first bristles is on a first set bristle mount and each of clusters of second bristles is secured to a second set bristle mount.

11. A hairbrush comprising:

a body including a head portion and a handle portion, the head portion including opposite sidewalls defining a central opening;

a panel extending across the central opening of the body, the panel including bristle supports each having a central bristle mount and at least three legs extending outwardly from the bristle mount; and at least one bristle secured to the bristle mount of each of the bristle supports, wherein the panel further includes a plurality of hubs, each leg of a bristle support being secured to a hub adjacent the associated bristle mount, wherein the panel further includes relatively thin bristles arranged in clusters at each of the hubs.

* * * * *